US007204047B2

(12) United States Patent
Murakami

(10) Patent No.: US 7,204,047 B2
(45) Date of Patent: Apr. 17, 2007

(54) COMPACT EXCAVATOR

(75) Inventor: Masayuki Murakami, Hiroshima (JP)

(73) Assignee: Kobelco Construction Machinery Co., Ltd., Hiroshima-shi (JP)

( * ) Notice: Subject to any disclaimer, the term of this patent is extended or adjusted under 35 U.S.C. 154(b) by 184 days.

(21) Appl. No.: 10/870,931

(22) Filed: Jun. 21, 2004

(65) Prior Publication Data

US 2004/0261299 A1 Dec. 30, 2004

(30) Foreign Application Priority Data

Jun. 24, 2003 (JP) ..... 2003-179562

(51) Int. Cl.
*E02F 5/02* (2006.01)

(52) U.S. Cl. ..... 37/347; 37/466; 180/69.22

(58) Field of Classification Search ..... 37/347, 37/466, 379; 180/69.22, 69.23, 89.13, 89.17, 180/89.18
See application file for complete search history.

(56) References Cited

U.S. PATENT DOCUMENTS

| | | | | |
|---|---|---|---|---|
| 3,960,238 | A * | 6/1976 | McClure et al. | 181/204 |
| 5,816,351 | A * | 10/1998 | Akira et al. | 180/68.1 |
| 6,009,643 | A * | 1/2000 | Maeba et al. | 37/443 |
| 6,170,180 | B1 * | 1/2001 | Schaeff | 37/443 |
| 6,430,852 | B2 * | 8/2002 | Murakami | 37/466 |
| 6,615,942 | B2 * | 9/2003 | Shinohara et al. | 180/69.21 |
| 2001/0007292 | A1 * | 7/2001 | Yabf | 180/68.1 |
| 2003/0150138 | A1 * | 8/2003 | Akahane et al. | 37/347 |
| 2003/0150663 | A1 * | 8/2003 | Farbotnik et al. | 180/312 |
| 2003/0154635 | A1 * | 8/2003 | Yukawa et al. | 37/347 |

FOREIGN PATENT DOCUMENTS

| | | |
|---|---|---|
| JP | 02279423 | * 11/1990 |
| JP | 06144022 | * 5/1994 |
| JP | 2002-161550 | 6/2002 |

* cited by examiner

*Primary Examiner*—Thomas A Beach
(74) *Attorney, Agent, or Firm*—Oblon, Spivak, McClelland, Maier & Neustadt, P.C.

(57) ABSTRACT

A compact excavator includes an upper rotating body mounted rotatably on a lower traveling body, an engine arranged on a rear section of the upper rotating body in a state where a drive shaft thereof is oriented in a horizontal direction, an hydraulic pump connected to the drive shaft, and a sound attenuating plate disposed on a front side of the engine across a width of the excavator. A longitudinal discontinuity is provided in a neighborhood of the pump so as to bring the sound attenuating barrier in a backward displaced state, a blocking portion for a longitudinal discontinuity in the sound attenuating barrier is provided with through holes, pipes extending from the pump, and communicating with a hydraulic device arranged on an outer periphery side of the upper rotating body on the opposite side of the pump are laterally inserted through the through holes.

6 Claims, 6 Drawing Sheets

COMPACT EXCAVATOR

BACKGROUND OF THE INVENTION

1. Field of the Invention

The present invention relates to a hydraulic excavator, and particularly relates to a rear small swing type compact excavator.

2. Description of the Related Art

Conventionally, in the hydraulic excavator with a short tail swing radius, various types of devices are arranged compactly on a rotating frame of an upper rotating body (refer to Japanese Patent Laid-Open Publication No. 2002-161550, for example).

A dividing wall is disposed in a transverse direction of the excavator at approximately center in a longitudinal direction, and on an engine side of this dividing wall are routed a plurality of pipes connecting a control valve with a hydraulic pump with each other.

Since the rotating frame is partitioned into front/rear sections by the dividing wall on this excavator, the pipes, which are preferably routed apart from the engine, have to be routed behind the dividing wall, namely in a neighborhood of the engine, due to a limited space.

In addition, if an opening portion for inserting through the pipes is provided on the dividing wall for passing through the pipes to the front side of the dividing wall, there is posed such a problem that engine sound escapes from this opening portion.

Further, if the pipes passing through the opening portion are connected to the control valve, for example, disposed on an outer periphery section of the rotating frame, it is necessary to bend the pipes largely on the rotating frame, and thus, this arrangement is not applicable to the compact excavator having a limited space used for installing devices.

SUMMARY OF THE INVENTION

An object of the present invention is thus to provide a compact excavator which allows to arrange pipes communicating with a hydraulic device at a position insulated from an engine, and simultaneously, to insulate an engine sound.

The compact excavator according to the present invention has the following principle constitution.

Namely, the compact excavator is comprised of an upper rotating body rotatably mounted on a lower traveling body, and an engine mounted on a rear section of the upper rotating body, and the engine is arranged in a state where a drive shaft thereof is oriented in a transverse (left/right) direction of the excavator. The compact excavator is further comprised of a hydraulic pump connected to the drive shaft, a hydraulic device arranged on an outer periphery side of the upper rotating body on an opposite side of the hydraulic pump in the transverse direction, and a soundproof plate disposed across a width of the excavator on a front side of the engine. This soundproof plate has a step, and this step is provided so as to bring the soundproof plate in a displaced state in a longitudinal direction viewed from a top. The compact excavator is still further comprised of a dividing portion arranged to block the step. The dividing portion has through holes, and the through holes are constituted such that pipes extending from the hydraulic pump, and communicating with the hydraulic device are inserted through the through holes.

In the present invention, the step may be formed by bending a part of the soundproof plate in a stair shape viewed from the top so as to form a bend serving as the step, or the step may be formed by arranging two soundproof plates displaced in the longitudinal direction, and are also overlapped each other, and then connecting a gap between the soundproof plates with the dividing portion.

According to the present invention, the step is provided on the soundproof plate disposed across the width of the whole excavator, the through holes are provided on the bend (dividing portion) in the longitudinal direction on the step, and the pipes are laterally inserted through the through holes. Alternatively, the dividing portion is provided so as to fill the gap formed between the two soundproof plates, the through holes are provided on the dividing portion, and the pipes are laterally inserted through the through holes.

Consequently, it is possible to compactly route the pipes on the front side of the soundproof plate without decreasing a sound insulation effect of the soundproof plate.

According to the present invention, the pipes extending from the hydraulic pump can be moved from the rear side of the soundproof plate to the front side thereof while the pipes are still routed along the soundproof plate by inserting the pipes through the through holes on the dividing portion constituting the step of the soundproof plate.

In the present invention, if the soundproof plate is comprised of two soundproof pieces on the both sides of the dividing portion, at least one of the soundproof pieces is preferably constituted so as to be detachable from a frame of the upper rotating body. As a result, it is possible to mount the soundproof piece after routing the pipes, resulting in an increase in efficiency of a pipe routing or arranging work.

DETAILED DESCRIPTION OF THE PREFERRED EMBODIMENTS

According to the present invention, a compact excavator is comprised of an upper rotating body mounted rotatably on a lower traveling body, an engine arranged on a rear section of the upper rotating body in a state where a drive shaft thereof is oriented in a horizontal direction, an hydraulic pump connected to the drive shaft, and a soundproof plate disposed on a front side of the engine across a width of the excavator. A step is provided in a neighborhood of the hydraulic pump so as to bring the soundproof plate in a state displaced backward as seen from a top plan view of the excavator. A dividing portion in a longitudinal direction on the step is provided with through holes. Pipes or hydraulic pipes extending from the hydraulic pump, and communicating with a hydraulic device arranged on an outer periphery side of the upper rotating body on the opposite side of the hydraulic pump are laterally inserted through the through holes.

A description will now be given of the construction machine according to the present invention based on embodiments shown in figures.

Figure 1:
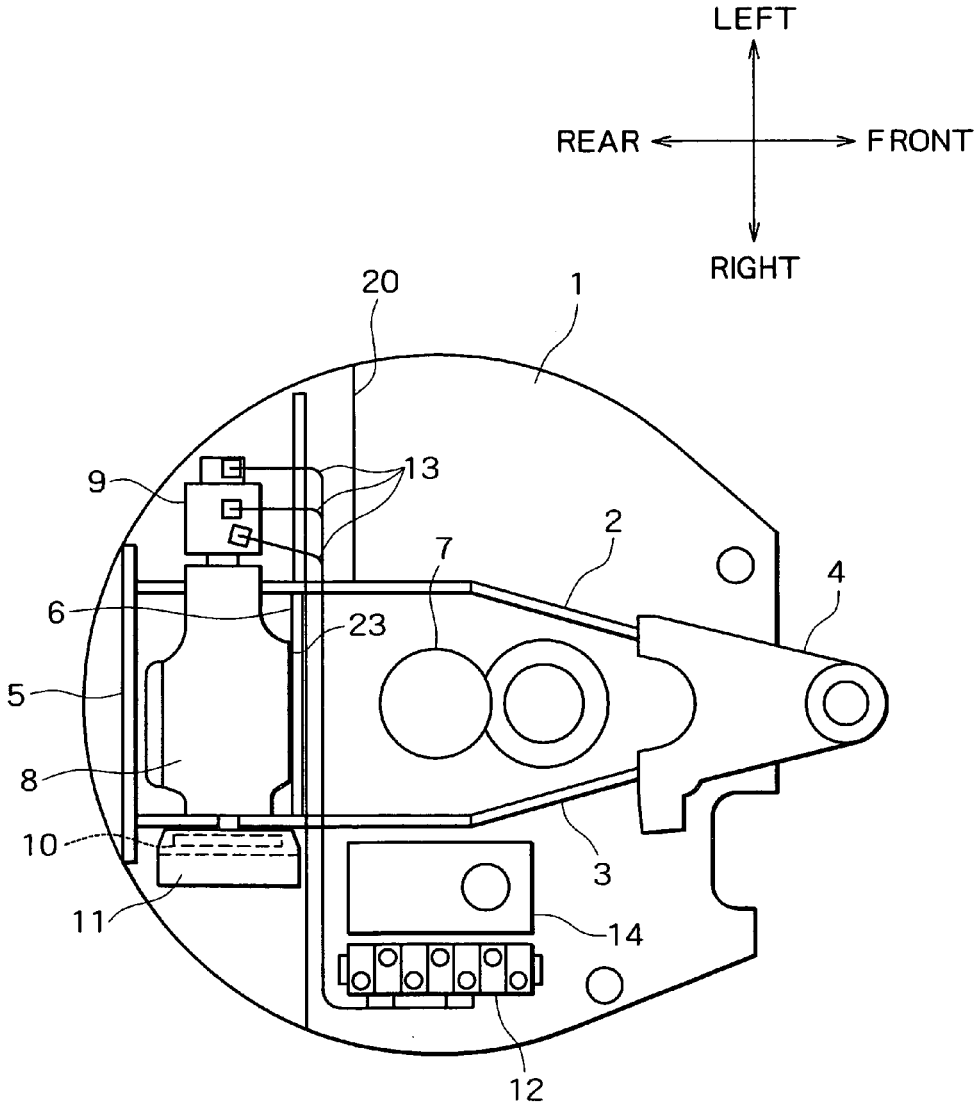
FIG. 1 is a plan view indicating a device arrangement on a rotating frame of a compact excavator according to the present invention.

FIG. 1 indicates an arrangement of respective devices inside the upper rotating body of the compact excavator according to the present invention. Especially, the present invention is preferably applied to a compact excavator with short tail swing radius constituted such that the swing radius of a rear section of the upper rotating body is fit within a width of the excavator.

In this figure, a pair of longitudinal ribs 2 and 3 are disposed in the longitudinal direction on the rotating frame 1 of the upper rotating body. Front ends of the longitudinal ribs 2 and 3 are connected to a swing bracket 4 used for supporting a swing boom (not shown). On the other hand, rear ends thereof are connected to a rear side rib 5 disposed in the horizontal direction on the rear section of the rotating frame 1. It should be noted that reference numeral 6 denotes a reinforcing rib connecting the longitudinal ribs 2 to 3, and reference numeral 7 denotes an opening for passing a swivel joint (not shown), provided on the lower traveling body. The upper rotating body is rotatably mounted on the lower traveling body.

The engine 8 is arranged on the rear section of the rotating frame 1 in the state where the drive shaft thereof is oriented in the horizontal direction. A hydraulic multiple pump 9 is directly connected to the output shaft of the engine 8.

In addition, a cooling fan 10 is provided on the right side of the engine 8, and a radiator 11 is arranged so as to oppose to the cooling fan 10.

A control valve 12 serving as a hydraulic device is arranged on a right outer periphery side of the rotating frame 1. The hydraulic pump 9 arranged on the left side of the rotating frame 1 and the control valve 12 are connected with each other using a plurality of delivery hoses 13 serving as the pipes. It should be noted that reference numeral 14 denotes a working oil tank.

Figure 2:
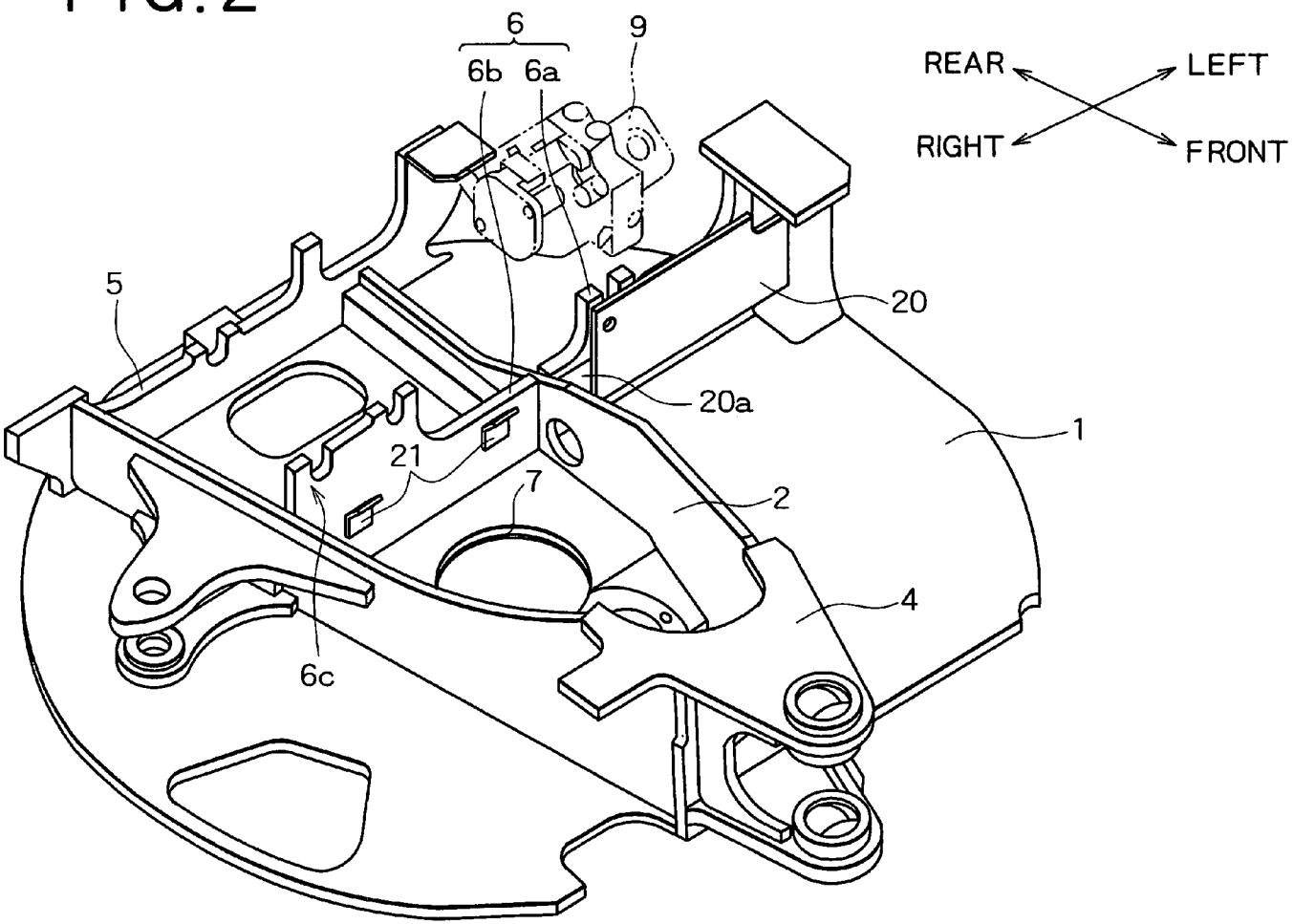
FIG. 2 is a perspective view showing a constitution of the rotating frame shown in FIG. 1.

FIG. 2 shows a view showing only the enlarged rotating frame 1. It should be noted that illustration is omitted for constitutions around the right longitudinal rib 3 for better understanding of constitutions around the reinforcing rib 6.

In this figure, a first reinforcing rib 6*a* is disposed on the front side of the hydraulic pump 9 indicated by a chain double-dashed line. A first soundproof plate (sound attenuating plate) 20 for insulating engine sound is provided on further the front side of the first reinforcing rib 6*a* in parallel with the first reinforcing rib 6*a*.

A lower section 20*a* of the first soundproof plate 20 is bent toward the first reinforcing rib 6*a*, and a lower end of the bent lower section 20*a* is fixed to the first reinforcing rib 6*a*.

A second reinforcing rib 6*b* in continuation from the first soundproof plate 20 on the both sides of the longitudinal rib 2 is arranged so as to be positioned on the front side of the engine 8 (see FIG. 1). A pair of receptacles 21, 21 for supporting a second sound proof plate described later are mounted on the left and right sides on a front wall surface 6*c* of the second reinforcing rib 6*b*.

Figure 3:
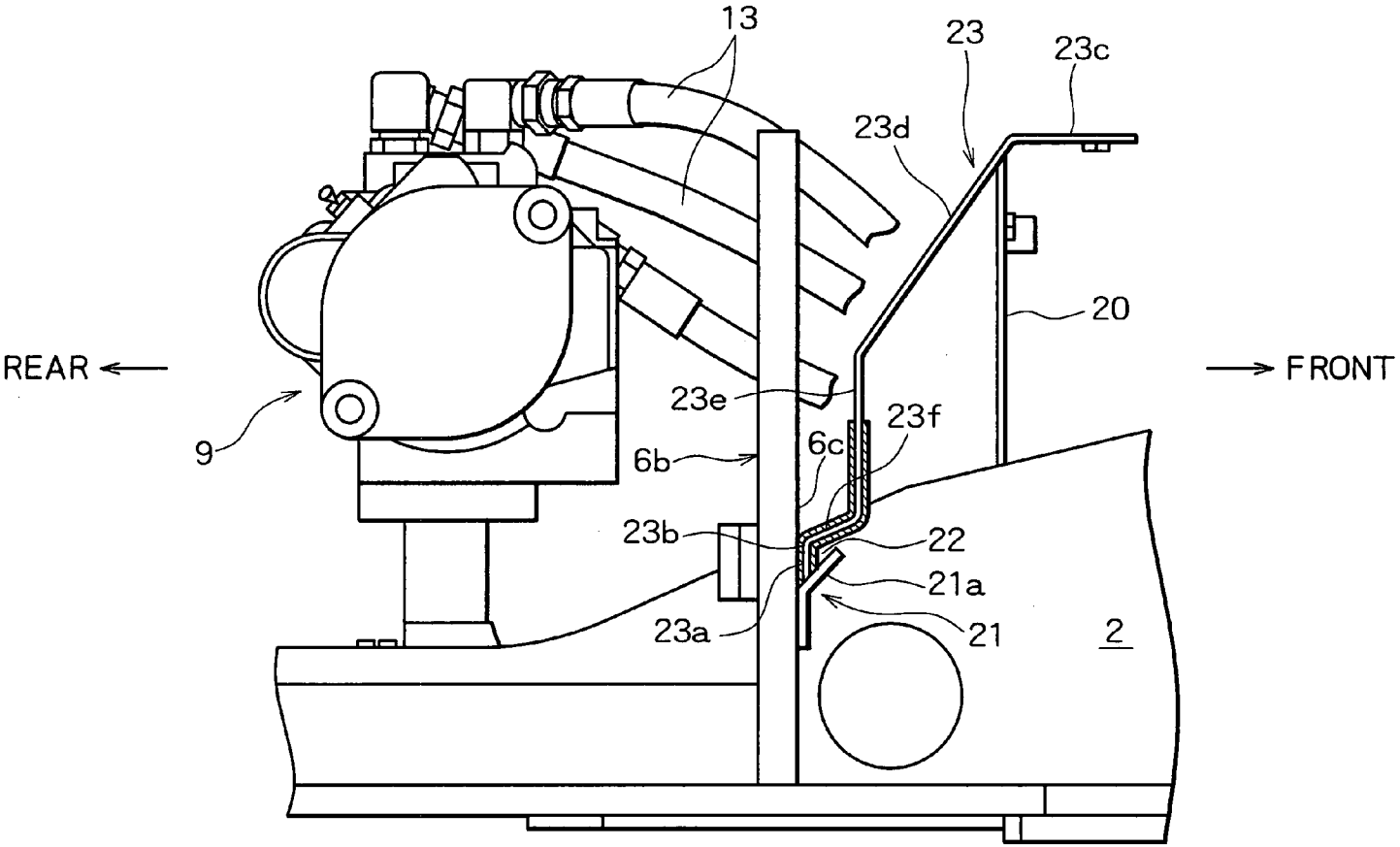
FIG. 3 is a side view of principal parts showing a constitution of a soundproof plate shown in FIG. 1.

The respective receptacles 21, 21 are formed in a dogleg shape (approximately an L shape) as a whole as shown in a side view of FIG. 3 by bending a upper section 21*a* thereof outward. The respective receptacles 21, 21 are fixed to the second reinforcing rib 6*b* so as to form a gap 22 in a wedge shape between the respective of them and the front wall surface 6*c*.

A lower end 23*a* of the second soundproof plate (sound attenuating plate) 23 described later is slid into these gaps 22. Namely, the second sound proof plate 23 is constituted so as to be detachable from the gaps 22, and an upper plate portion 23*c* thereof is screwed to a frame for a seat stand (not shown), when the second sound proof plate 23 is fixed.

It should be noted that rubber 23*b* in a U shape is mounted on the lower edge 23*a* of the second soundproof plate 23 as a member for filling a gap between the second reinforcing rib 6*b* and the lower edge 23*a* of the second soundproof plate 23 for preventing generation of the gap.

Figure 4:
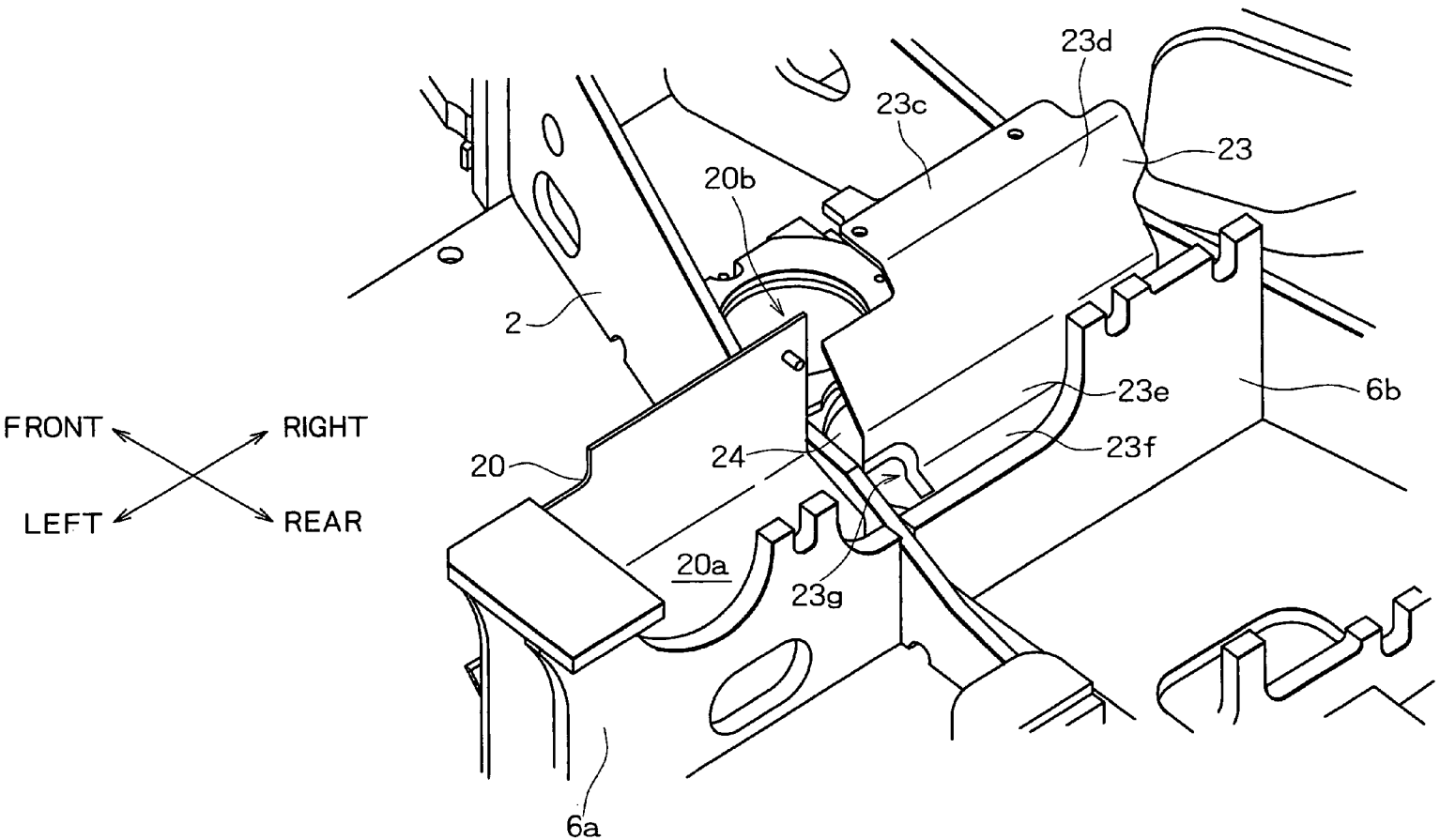
FIG. 4 is an enlarged perspective view showing the constitution of the soundproof plate shown in FIG. 1.

FIG. 4 shows a positional relationship between the first soundproof plate 20 and the second soundproof plate 23, and is viewed from the rear side of the rotating frame 1.

In this figure, the second soundproof plate 23 is comprised of the horizontal top plate portion 23*c*, an inclined plate portion 23*d* inclining downward toward the rear side from the upper plate portion 23*c*, a vertical plate portion 23*e* suspended from an lower section of the inclined plate portion 23*d*, and a supported plate portion 23*f* further extended downward from the vertical plate portion 23*e*, and locked by the respective receptacles 21, 21. It should be noted that the respective receptacles 21, 21 are located behind the second reinforcing rib 6*b*, and thus, are not shown in FIG. 4.

In addition, a cutout portion 23*g* is formed spanning from the vertical plate portion 23*e* to the supported plate portion 23*f*. The cutout portion 23*g* is used for bringing the second soundproof plate 23 in contact with an upper side corner portion 20*b* of the first soundproof plate 20 while passing over the longitudinal rib 2.

After the first soundproof plate 20 and the second soundproof plate 23 have come in contact with each other in this way to form a sound attenuating barrier, the first soundproof plate 20 and the second soundproof plate 23 are arranged in a state displaced from each other in the longitudinal direction. Consequently, a longitudinally displaced portion or step is formed, and thus, an opening portion or longitudinal discontinuity 24 in a triangle shape is formed between both of the plates 20 and 23.

Figure 5:
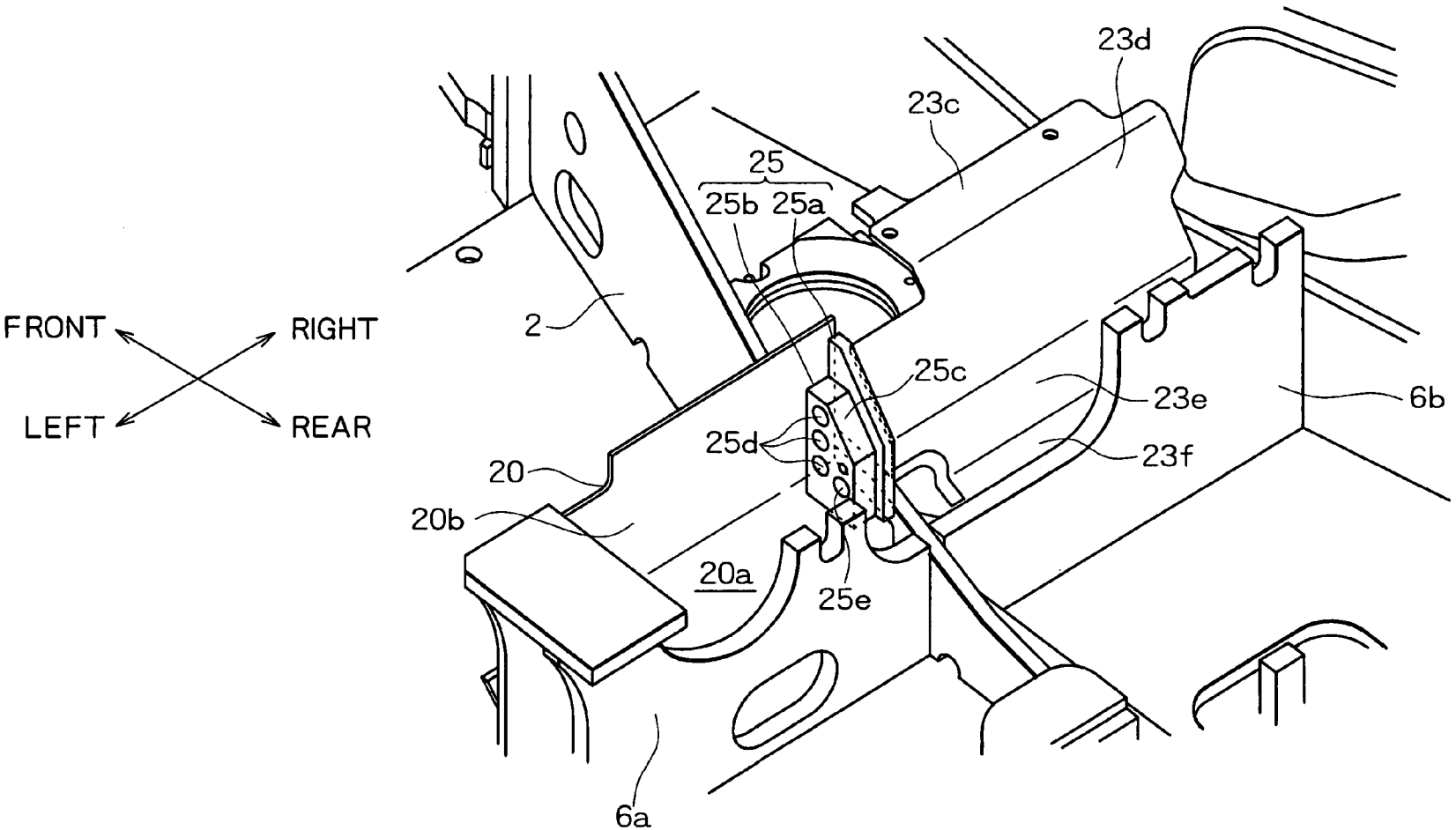
FIG. 5 is a perspective view showing a constitution of a pipe block mounted on an opening portion shown in FIG. 4.

This longitudinal discontinuity 24 is blocked by a pipe block or blocking portion 25 serving as a dividing portion shown in FIG. 5.

This pipe block 25 is comprised of a rubber seal member formed into a block shape. Further, the pipe block 25 is constituted by a seal portion 25*a* in a triangle shape corresponding to the triangle shape of the opening portion 24, and a mounting portion 25*b* integrally formed with the seal portion 25*a* by providing a step along an outside of the seal portion 25*a*.

The seal portion 25*a* is constituted so as to be in close contact with a respective left edge portion of the inclined plate portion 23*d* and the vertical plate portion 23*e* of the second soundproof plate 23, and to be in close contact with a right side edge portion of the rear side wall surface 20*b* of the first soundproof plate 20, thereby blocking the opening portion 24.

A metal fitting 26 (see FIG. 6) formed in correspondence with the step portion 25*c* of the mounting portion is wound around the mounting portion 25*b* for being fixed to the first soundproof plate 20.

In addition, a plurality of pipe through holes 25*d* are bored in a vertical arrangement in the pipe block 25, and the respective pipe through holes 25*d* pass through in the horizontal direction with respect to the mounted state of the pipe block 25. This pipe block 25 also functions as a pipe support member for supporting the delivery hoses 13. It should be noted that a pipe through hole 25*e* is a reserved hole, and is blocked by a plug when unnecessary.

Figure 6:
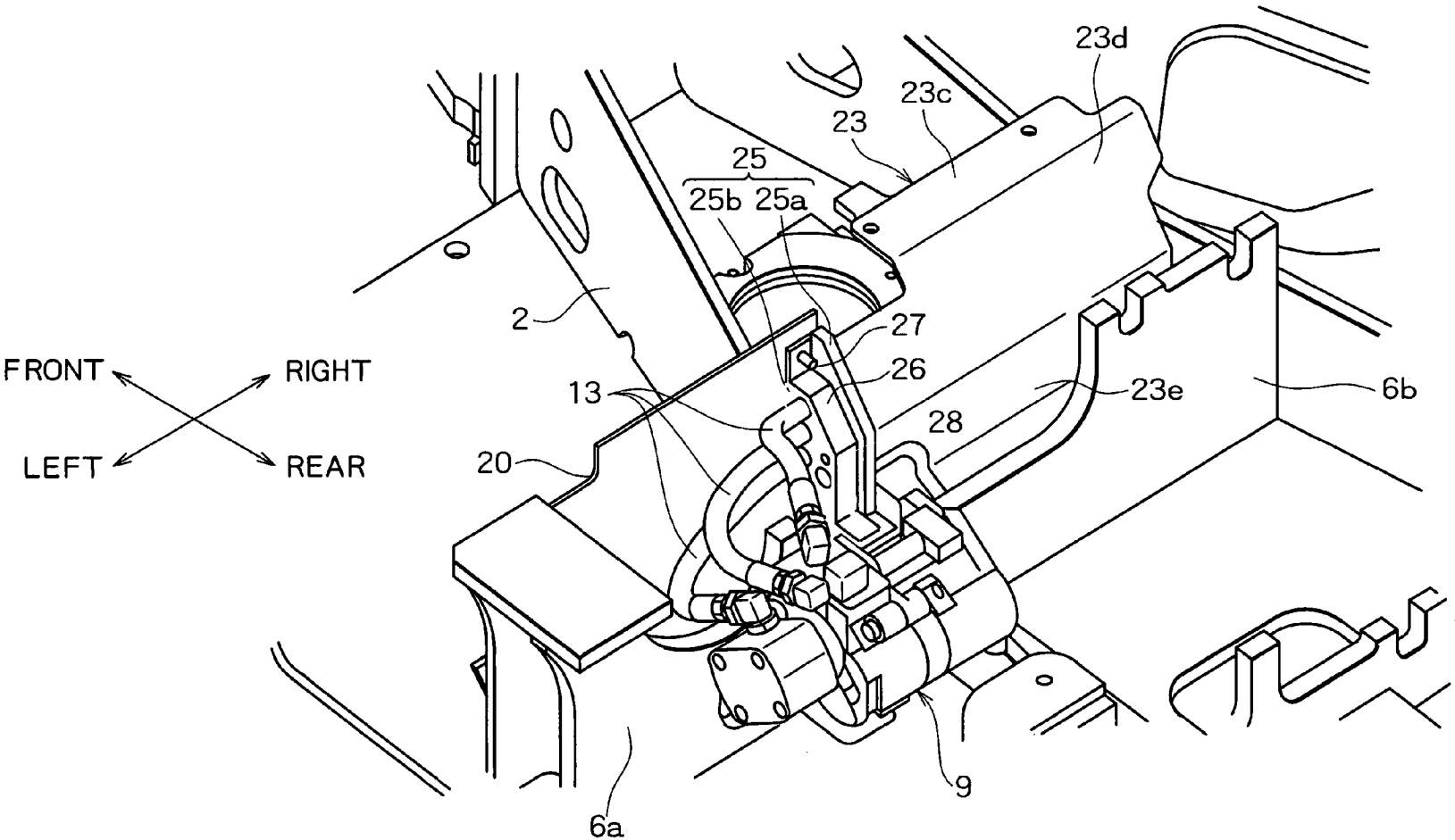
FIG. 6 is a perspective view showing a routing state of delivery hoses in the pipe block.

FIG. 6 shows a state where delivery hoses 13 extended from the hydraulic pump 9 are passed through the pipe block 25.

A process for installing the pipe block 25 is described below. In the figure, first, the delivery hoses 13 are passed thorough the pipe through holes 25*d* in the pipe block 25, and the opening portion 24 is blocked by the pipe block 25 through which the delivery hoses 13 are passed. Then, the pipe block 25 is fixed to the first soundproof plate 20 using the metal fitting 26. In the figure, reference numerals 27 and 28 denote bolts for fixing the metal fitting 26 and the first soundproof plate 20 to each other.

In this way, the present embodiment is constituted such that the soundproof plates are divided into the two portions, the both soundproof plates 20 and 23 are displaced in the longitudinal direction for securing the gap (opening portion 24), and the delivery hoses 13 are passed through in the lateral direction using the gap. As a result, the delivery hoses 13 after passing through the pipe block 25 changes the positions thereof from the rear side to the front side of the soundproof plates in the course of routing from the first soundproof plate 20 to the second soundproof plate 23, then are routed along the second soundproof plate 23, and are connected to the control valve 12. Consequently, the delivery hoses 13 can be separated from the engine 8. At the same time, the first soundproof plate 20 and the second soundproof plate 23 are continuous via the pipe block 25, and thus, the sound insulation effect can be maintained.

It should be noted that though the soundproof plates are constituted as independent components in the above embodiment, the constitution of the soundproof plate is not limited to that described in the above embodiment, and the first soundproof plate 20 and the second soundproof plate 23 may be formed as a single plate, and the step for realizing the displacement in the longitudinal direction may be formed by press molding. Then, through holes may be bored on a dividing portion in the longitudinal direction on the step, and the delivery hoses 13 are inserted through the through holes.

It should be noted that it is necessary to form the through holes such that the diameter thereof is larger than that of the delivery hoses 13 for easily inserting the delivery hoses 13 through the through holes, and to fill a respective gap between the hose 13 and the through hole with an elastic seal member so as to support the delivery hoses 13.

As described above, it is preferable to provide the pipe block 25 as the seal member in the block shape which blocks the gap between the first soundproof plate 20 and the second soundproof plate 23 functioning as the two soundproof pieces. As a result, the plurality of through holes can be arranged in the vertical direction on the seal member. Consequently, the soundproof plates are continuous via the dividing portion, and thus, the soundproof effect can be maintained. Also, the plurality of pipes can be routed using the pipe space corresponding to one pipe viewed from the top, and thus the pipe space occupied within the rotating frame can be saved.

Although the invention has been described with reference to the preferred embodiments in the attached figures, it is noted that equivalents may be employed and substitutions made herein without departing from the scope of the invention as recited in the claims.

I claim:

1. A compact excavator comprising:

an upper rotating body mounted rotatably on a lower traveling body;

an engine mounted on a rear section of said upper rotating body, and arranged in a state where a drive shaft thereof is oriented in a transverse direction of the excavator;

a hydraulic pump connected to said drive shaft;

a hydraulic device arranged on an opposite side of said hydraulic pump in the transverse direction on an outer periphery side of said upper rotating body;

a sound attenuating barrier disposed on a front side of said engine across the width of the excavator, said sound attenuating barrier having a portion displaced in a longitudinal direction of the excavator, which longitudinal direction is perpendicular to the transverse direction, thereby providing a discontinuity in the sound attenuating barrier extending in the longitudinal direction; and a blocking portion arranged at said discontinuity so as to block said discontinuity, said blocking portion having a through hole into which a conduit extended from said hydraulic pump and communicating with said hydraulic device is inserted.

2. The compact excavator according to claim 1, wherein said sound attenuating barrier is arranged in a neighborhood of said hydraulic pump.

3. The compact excavator according to claim 1, wherein said sound attenuating barrier comprises two sound attenuating pieces arranged on both sides of said discontinuity and relatively displaced from one another in the longitudinal direction.

4. The compact excavator according to claim 3, wherein one of said sound attenuating pieces is detachably installed on a frame of said upper rotating body.

5. The compact excavator according to claim 3, wherein said blocking portion comprises a seal member in a block shape, and said through hole is formed at said seal member.

6. The compact excavator according to claim 5, wherein said seal member has more than one of said through holes, said through holes being arranged in a vertical direction.

* * * * *